US005800283A

United States Patent [19]

Nomura

[11] Patent Number: 5,800,283

[45] Date of Patent: Sep. 1, 1998

[54] KNEELING PUTTER

[76] Inventor: Sueki Nomura, 12-15, Higashimachi 1-chome, Kichijoji, Musashino-shi, Tokyo, Japan, 180

[21] Appl. No.: 537,657

[22] PCT Filed: Apr. 4, 1995

[86] PCT No.: PCT/JP95/00648

§ 371 Date: Oct. 24, 1995

§ 102(e) Date: Oct. 24, 1995

[87] PCT Pub. No.: WO95/33530

PCT Pub. Date: Dec. 14, 1995

[30] Foreign Application Priority Data

Jun. 6, 1994 [JP] Japan ..... 6-008136

[51] Int. Cl.[6] ..... A63B 53/00; A63B 53/14

[52] U.S. Cl. ..... 473/294; 473/300; 473/409; 473/313

[58] Field of Search ..... 473/294, 296, 473/314, 300, 293, 316, 251, 340, 243, 325, 313, 409

[56] References Cited

U.S. PATENT DOCUMENTS

| | | | |
|---|---|---|---|
| 2,843,384 | 7/1958 | Schmidt | 473/294 |
| 3,042,405 | 7/1962 | Solheim | 473/325 |
| 3,430,963 | 3/1969 | Wozniak | 473/293 |
| 3,486,755 | 12/1969 | Hodge | 473/293 |
| 3,574,349 | 4/1971 | Kropp | 473/294 |
| 4,163,554 | 8/1979 | Bernhardt | 473/294 |
| 4,592,552 | 6/1986 | Garber | 473/294 |
| 4,605,228 | 8/1986 | Guendling | 473/293 |
| 4,674,747 | 6/1987 | Mazzocco | 473/296 |
| 4,795,158 | 1/1989 | Kuykendall | 473/325 |
| 5,024,438 | 6/1991 | Candon | 473/294 |
| 5,176,379 | 1/1993 | Reinberg | 473/340 |
| 5,333,863 | 8/1994 | Shenoha | 473/314 |
| 5,415,399 | 5/1995 | Kettelson | 473/294 |

FOREIGN PATENT DOCUMENTS

| | | | |
|---|---|---|---|
| 28613 | 7/1974 | Japan . | |
| 1209466 | 10/1970 | United Kingdom | 273/80 C |

OTHER PUBLICATIONS

"Amway", catalog, Feb. 1988 issue, p. 21.

"Taper Scopic", advertisement for putter.

*Putt Like The Pros* by Dave Pelz, in collaboration with Nick Mastroni, published by Harper–Perineal, copyright 1989. Chapter 10, "Learn Your Set–Up From Perfy", (pp. 79–93); Chapter 17 How Well Does Your Putter Fit You?, (pp. 177–191).

*Primary Examiner*—Sebastiano Passaniti

[57] ABSTRACT

In a kneeling putter, a shaft is secured to and obliquely risen on a top of a head at its central portion toward a player. The shaft has grips at upper and lower ends thereof and has a length of 65 cm which is shorter than that of the conventional putter. Thus, it is possible to eliminate, to the utmost, a deviation and a gap existing with the use of the conventional golf putter between a ball putting direction and a sight line when the player sights the ball putting direction, thereby providing a great improvement in accuracy of putting by a simple putting motion.

4 Claims, 1 Drawing Sheet

KNEELING PUTTER

TECHNICAL FIELD

The present invention relates to a putter which will provide an improved accuracy especially for putting in golf competitions or tournaments.

BACKGROUND ART

Many of conventional putters each have a long slender face which is about 20 cm ×10 cm in size, and a shaft which is about 80 cm long.

In the conventional putter, there is a long distance between a grip of the putter and a point at which a ball strikes a head of the putter. There is opportunity for a large deviation or gap to occur between a direction for the ball to actually advance forwardly and the sight line for determining desired direction. Therefore, it is very difficult for exact putting to occur.

Accordingly, it is an object of the present invention to overcome the above problem and to improve the accuracy of putting at least to a slight extent.

DISCLOSURE OF THE INVENTION

To achieve the above object, according to the present invention, there is provided a kneeling putter, comprising a shaft rising obliquely from a central portion of a top of a putter head at an angle of 10° to 15° from a perpendicular line toward a player, the shaft having a length of about 65 cm, and grips provided at two points on the shaft.

The putter according to the present invention is used with the player kneeling directly over the ball and therefore, the shaft is shorter than that of the conventional putter. The player's hand on the upper grip is used like a fulcrum activated by a light stroke from the player's shoulder, and the player's hand on the lower grip on the shaft putts the ball at the head with a pendulum-like swing.

With the player's eye closer to the ball and the grip (the lower grip that actually putts) closer to the point where the ball is truck, it is possible to putt the ball with a simple swing and an exact aim. Also, in the case of long putts, the putter according to the present invention can be used to putt the ball in a standing posture as assumed in putting with the conventional putter. Further, the putter according to the present invention has opposite faces which allow for right-handed and left-handed putting.

BEST MODE FOR CARRYING OUT THE INVENTION

A first embodiment of the present invention will now be described with reference to the accompanying drawings.

Figure 1:
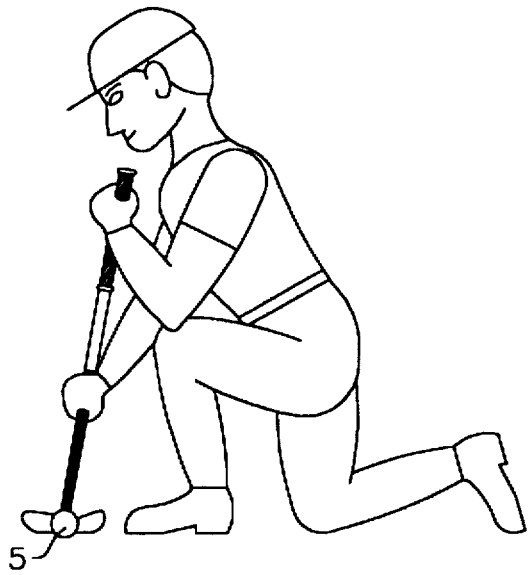
FIG. 1 is a diagrammatic illustration of situation using a putter according to the present invention.

Referring to FIG. 1 showing a situation using the putter according to the present invention, the player's eye is directly above the ball 5 which is about to be putted. One of the player's hands grasps the upper grip 3, and the player's fist is held in light contact with near the shoulder. The other hand grasps the lower grip 4 and simply swings the shaft in a pendulum-like manner. An upper extremity of the lower grip and a lower extremity of the upper grip are separated by a length of putter shaft substantially equal to the length of putter shaft embraced by each of the grip at the upper end and the grip at the lower end of the putter shaft.

Figure 2:
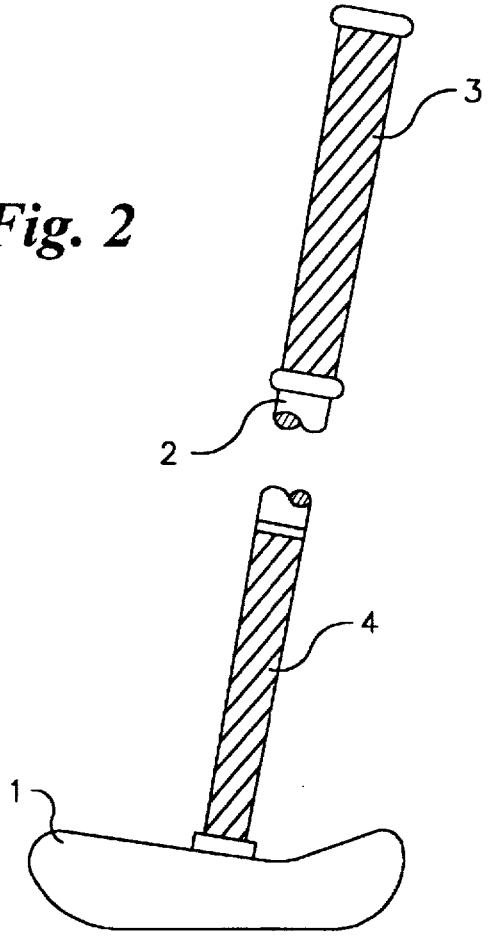
FIG. 2 is a partially broken-away side view of the putter shown in FIG. 1.

FIG. 2 is a side view of the putter according to the present invention. The shaft 2 is fixed to the central portion of the head 1 at an angle of 10 to 15 degrees from a perpendicular line toward the player. The shaft is about 65 cm long. Therefore, the fist grasping the upper grip 3 comes just to near the shoulder.

EFFECT OF THE INVENTION

The putt according to the present invention is constructed and operated in the above-described manner and therefore, when the player is sighting the putting direction, the player's eye can be put closer to the ball, as compared with the case where the conventional putter is used, and thus, the player can have a confidence in the aim. In addition, the putting motion is no longer unstable as in the conventional manner and is a simple pendulum-like movement which will produce no error, thus providing an effective and remarkable improvement in accuracy of putting.

What is claimed is:

1. A method of golf putting using a short shafted putter in which the player using the putter while kneeling grips an end of the putter with one hand proximate an end of a shaft remote from a putter head and with the other hand grips the shaft proximate to the putter head so the hands are widely spaced apart, places his eyes vertically over a ball to be struck by the putter and aligns a putter head striking face perpendicular to a selected path of travel for the ball and, while holding the hand at the remote end of the shaft relatively still to provide a fulcrum, the player uses the other hand gripping the shaft proximate the head to move the putter head back from the ball along an arc perpendicular to the striking face, and then, in a pendulum-like movement, reverses direction and moves the club putter head along the same arc through the ball.

2. The method of golf putting using a short shaft putter of claim 1 in which the player keeps the one hand gripping the end of the shaft remote from the putter head in the constant position by touching the elbow of the same arm to one knee in the kneeling position.

3. A kneeling putter comprising:

a. a shaft rising obliquely from a top of a putter head at its central portion at an angle from a perpendicular line towards a player using the putter, said shaft having a length comfortable for gripping by a kneeling player such that one hand below the level of the player's head can be placed toward an end of the shaft remote from the head and the other hand placed proximate to the putter head;

b. grips provided at an upper end portion and a lower end portion of said shaft, so that the shaft may be gripped by a player in a kneeling position in those widely spaced grip regions while allowing the eyes of the player to be positioned vertically above the ball;

c. said grips spaced one from another on said shaft; and d. said grip provided at the upper end portion of said shaft has an upper extremity coincident with the vertical extremity of said shaft remote from said head, wherein said grip at the lower end portion of said shaft has a lower extremity coincident with a lower end of said shaft contacting said head; wherein said upper extremity of an lower grip and a lower extremity of said upper grip are separated by a length of putter shaft substantially equal to the length of putter shaft embraced by each of said grip at said upper end portion and said grip at said lower end of said putter shaft.

4. A kneeling putter comprising:

a. a shaft rising obliquely from a top of a putter head at the head central portion at an angle of 10° to 15° from a perpendicular line towards a player, said shaft having a length of about 65 cm;

b. grips provided at an upper end portion and a lower end portion of said shaft;

c. said putter head having opposite faces allowing for right-handed and left-handed putting and making a user of said kneeling putter kneel on a base in common with said putter head;

d. said putter head provides faces on opposite sides of the putter head generally parallel to one another and generally parallel to a plane containing the shaft;

e. said grips are spaced one from another on said shaft; and f. said grip provided at the upper end portion of said shaft has an upper extremity coincident with the vertical extremity of said shaft remote from said head, wherein said grip at the lower end portion of said shaft has a lower extremity coincident with a lower end of said shaft contacting said head; wherein an upper extremity of said lower grip and a lower extremity of said upper grip are separated by a length of putter shaft substantially equal to the length of putter shaft embraced by each of said grip at said upper end portion and said grip at said lower end of said putter shaft.

* * * * *